US009822565B2

(12) United States Patent
Milder et al.

(10) Patent No.: US 9,822,565 B2
(45) Date of Patent: Nov. 21, 2017

(54) VEHICLE WITH REMOVABLE FLAP

(71) Applicant: GM GLOBAL TECHNOLOGY OPERATIONS LLC, Detroit, MI (US)

(72) Inventors: Udo Milder, Ruesselsheim (DE); Frank Leopold, Taunusstein-Orlen (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 78 days.

(21) Appl. No.: 15/067,945

(22) Filed: Mar. 11, 2016

(65) Prior Publication Data

US 2016/0263972 A1 Sep. 15, 2016

(30) Foreign Application Priority Data

Mar. 13, 2015 (DE) ..... 10 2015 003 291

(51) Int. Cl.
*E05D 7/10* (2006.01)
*E05D 5/02* (2006.01)

(52) U.S. Cl.
CPC ..... *E05D 7/10* (2013.01); *E05D 5/0207* (2013.01); *E05Y 2600/56* (2013.01); *E05Y 2900/546* (2013.01)

(58) Field of Classification Search
CPC . B60J 5/101; E05D 2007/1038; E05D 5/0207
USPC ..... 296/56, 146.8, 146.11
See application file for complete search history.

(56) References Cited

U.S. PATENT DOCUMENTS 4,102,011 A * 7/1978 Clack, Jr. ..... B64C 1/1407 16/261
4,720,895 A * 1/1988 Peebles ..... E05D 7/121 16/248
5,297,314 A * 3/1994 Bender ..... E05D 7/121 16/270
5,682,646 A * 11/1997 Tyler, IV ..... E05D 5/062 16/264
6,860,542 B1 * 3/2005 Zabtcioglu ..... B60J 5/047 292/144
2006/0273619 A1 * 12/2006 Miller ..... E05D 3/125 296/146.8

(Continued)

FOREIGN PATENT DOCUMENTS

DE 19633152 A1 2/1998

OTHER PUBLICATIONS

German Patent Office, German Search Report for German Application No. 102015003291.7, dated Jul. 29, 2015.

*Primary Examiner* — Jason S Morrow
(74) *Attorney, Agent, or Firm* — Lorenz & Kopf, LLP

(57) ABSTRACT

A swing panel or flap is pivotally attached to a vehicle body with a hinge. The hinge includes a first fitting part fastened to a first selected vehicle part under the body and flap, and a second fitting part fastened to the second selected vehicle part under the body and flap. The second fitting part is joined with the first fitting part so that it can pivot around a hinge axis. A head of a post of the first vehicle part is inserted through a passage of the first fitting part. A control part is movable between a locked position, in which it engages between an undercut of the head and the first fitting part, and a released position, in which it is retracted from the undercut, and the head is free to traverse the passage.

14 Claims, 3 Drawing Sheets

(56) References Cited

U.S. PATENT DOCUMENTS

2008/0129082 A1* 6/2008 Krumbiegel ..... E05D 7/121
296/146.11

* cited by examiner

VEHICLE WITH REMOVABLE FLAP

CROSS-REFERENCE TO RELATED APPLICATION

This application claims priority to German Patent Application No. 102015003291.7, filed Mar. 13, 2015, which is incorporated herein by reference in its entirety.

TECHNICAL FIELD

The present disclosure pertains to a vehicle with a body and a swing panel or flap pivoted to the body with a hinge. In particular when the flap is a luggage compartment flap, it is in principle desirable to be able to remove the flap, for example to transport cargo that does not fit into the luggage compartment with the flap closed, or if goods have to be loaded or unloaded while traveling to a plurality of locations, to which end access must be frequently gained to the luggage compartment.

BACKGROUND

Known from DE 196 33 152 A1 is a vehicle with a body and a removable flap that is pivoted to the body with a hinge. The flap is mounted on a roof cross member, in which a body-side hinge part is placed on an auxiliary plate on the roof cross member, and fixed thereto with a threaded fastener. It is virtually impossible for one person to hold the tailgate with the hinge fastened thereto on the auxiliary plate while at the same time placing a threaded fastener and tightening it. Therefore, mounting and dismounting the tailgate requires at least two people and a considerable expenditure of time.

SUMMARY

The present disclosure provides a vehicle in which a swing panel or flap can be quickly, reliably and easily mounted and demounted to and from the body with a hinge. In particular, a vehicle includes a body and a swing panel or flap pivoted to the body with a hinge having a first fitting part to be fastened to a first selected vehicle part under the body and flap and a second fitting part to be fastened to the second selected vehicle part under the body and flap. The second fitting part is joined with the first fitting part so that it can pivot around a hinge axis. A head of a post of the first vehicle part is inserted through a passage of the first fitting part. A control part is moveable between a locked position, in which it engages between the undercut of the head and the first fitting part, and a released position, in which it is retracted from the undercut, and the head is free to traverse the passage.

In order to fasten the flap to the body, it is here sufficient to shift the control part into the locked position. In particular having the control part be a fixed constituent of the hinge precludes a situation in which, even though a user has placed the flap on the body in such away that it can be fastened by folding the first hinge part over the post, it cannot be fastened because an aid required to do so, such as a threaded fastener, is not within reach.

If the control part is a constituent of the hinge that is not intended for removal as opposed to a threaded fastener, the required movability of the control part between the locked position and released position can be achieved by pivoting around an axis.

The control part can exhibit a slot at the edge, into which the head of the post engages in the locked position. If the control part can be pivoted around an axis, the slot preferably extends on a cylindrical surface centered on the pivoting axis of the control part in its circumferential direction. The axis around which the control part is able to pivot can be the hinge axis itself. If it does not coincide with the hinge axis, it should run between the hinge axis and the passage to maintain the compact design of the hinge.

The first fitting part includes a base plate in which the passage is formed, and straps angled on either side of the base plate that holds at least one shaft. This shaft can form the hinge axis and/or pivoting axis of the control part. If both do not coincide, the two shafts can also be held in the straps, one for each axis.

An actuating lever of the control part can protrude from a gap between the straps in the locked position, so as to be easily grasped and make unlocking convenient.

The second hinge part can be arranged or formed in such a way in the closed position of the flap as to block a movement by the control part in the released position. This precludes an unintended transfer of the control part into the unlocked position with the flap closed.

The second hinge part and control part can have arranged between them a buffer, which is pressurized in the closed position of the flap, and thus impinges upon the control part in the locked position every time the flap is closed.

The undercut can be formed by a side wall of a groove extending around the head of the post. This simplifies vehicle assembly, since no attention must be paid to the orientation of the post when placing the post on the first vehicle part.

A passage traversed by the head of the post can be formed on the first vehicle part. If a base of the post abuts against a side of the first vehicle part facing away from the hinge, a detachment of the post from the first vehicle part in the locked position is prevented even if the post is not securely anchored on the first vehicle part or such an anchoring has been destroyed.

While the flap will be a luggage compartment flap in most practical applications, the present disclosure can also be applied to other flaps, such as a hood or door of the vehicle.

If the first vehicle part mentioned above is the body and the second vehicle part is the flap, then the hinge can also be detached from the vehicle body along with the flap.

If the first fitting part has been folded over the post from above while assembling the flap, the engagement of the post and weight of the second vehicle part will temporarily hold it in place on the first vehicle part until the control part has been moved to the locked position. This helps a user to more reliably assemble the flap.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
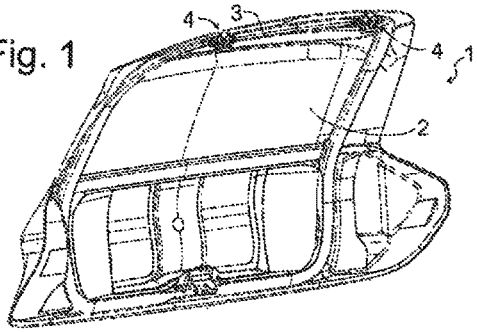
FIG. 1 is a luggage compartment flap of a motor vehicle.

FIG. 1 shows a perspective view from the inside of a luggage compartment swing panel or flap 1 of a motor vehicle. Sheet metal parts of the luggage compartment flap form a frame all around a rear window 2. Secured to an upper profile 3 of the frame are two hinges 4, the structural design of which will be described in greater detail below.

Figure 2:
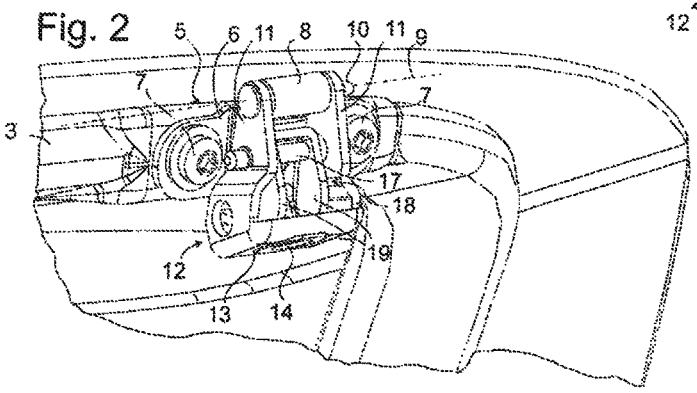
FIG. 2 is a detail of the luggage compartment flap from FIG. 1.

The two hinges 4 are structurally identical, so that it is sufficient to show only one of them in a magnified view on FIG. 2. A fitting part 5 on the flap side formed as a single piece out of a strong sheet metal includes a base plate 6, which is fastened by two threaded fasteners 7 to the upper profile 3 so as to flatly abut the latter, and a tongue protruding from an upper edge of the base plate 6, which is rolled up to form a joint area 8 that rotatably incorporates a pin 10 that defines the pivoting axis 9 of the hinge 4. The pin 10 passes through two straps 11 of a body-side fitting part 12 on either side of the joint area 8. Just as on the flap side, the fitting part 12 is formed as a single piece out of a strong sheet metal on the body side, and the two straps 11 are joined together as a single piece by a base plate 13. A circular passage 14 is visible in the base plate 13. The passage 14 is provided to incorporate the head 16 of a post 15 anchored to the roof frame of the vehicle body, which will be described in greater detail later with reference to FIG. 4.

A second pin 17 is suspended on the straps 11 between the base plate 13 and the pin 10, parallel to the latter. This pin 17 forms a pivoting axis of a control part 18, of which essentially only two lateral walls 19 parallel to the straps 11 are discernible on FIG. 2 between the straps 11.

Figure 3:
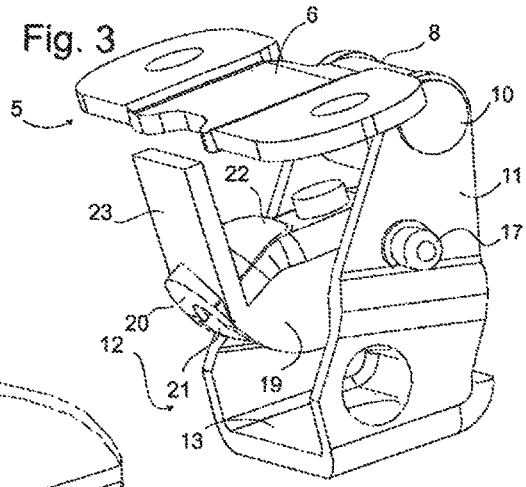
FIG. 3 is an isolated hinge of the luggage compartment flap.

The control part 18 is more clearly discernible from the isolated view of the hinge 4 on FIG. 3. In this view, the control part 18 is pivoted out of the gap away from the straps 11 in the direction of the vehicle rear, thus making visible a cylindrical wall 20 extending between the lower edges of the lateral walls 19 and centered roughly on the pin 17. A slot 21 is recessed in the cylindrical wall 20. The slot 21 is open toward a front edge of the cylindrical wall 20 hidden between the straps 11 on FIG. 3. A rear wall 22 of the control part 18 that joins the two lateral walls 19 faces upward in the released position shown on FIG. 3, and a gripping section 23 protrudes upwardly from a lower end of the rear wall 22. The cylindrical wall 20 does not overlap the base plate 13 in the released position.

Figure 4:
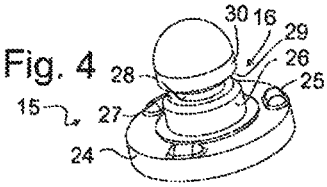
FIG. 4 is a post for anchoring the hinge on the body side.

The post 15 shown on FIG. 4 has a foot 24 in the form of a disk, from which the head 16 centrally protrudes. Distributed around the head 16 on the upper side of the foot 24 are welding projections 25, which are provided to be resistance-welded to the roof frame when the post 15 has been inserted into a passage of a roof frame.

The length of a first cylindrical area 26 of the head 16 as viewed from the foot 24 is dimensioned in such a way that, when the post 15 is welded to the roof frame and the hinge 4 has been placed on the roof frame so that the head 16 engages into the passage 14, a flank 27 between the first cylindrical area 26 and a groove 28 upwardly adjoining the latter is flush with the upper side of the base plate 13. In this way, when the control part 18 is downwardly pivoted out of the released position shown on FIG. 3 into the locked position, the head 16 can slip into its slot 21, wherein the edges of the cylindrical wall 20 bordering the slot 21 engage into the groove 28, and a frictional contact between the inside of the cylindrical wall 20 and a flank 29 upwardly bordering the groove 28 toward a second cylindrical area 30 ensures that the body-side fitting part 12 is firmly seated on the post 15.

Figure 5:
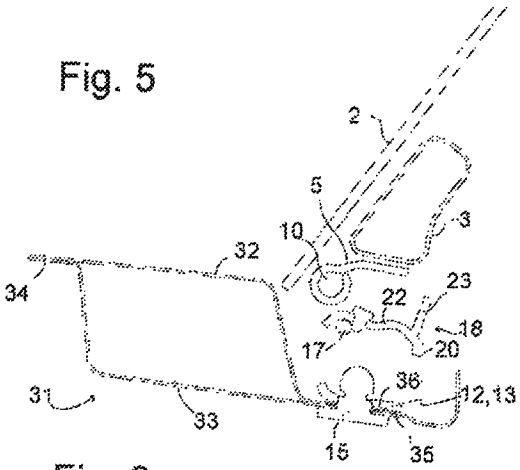
FIG. 5 is a section through a roof frame of a vehicle body and a luggage compartment flap, the hinge of which has been placed on a post of the roof frame, but not yet locked thereto.
Figure 6:
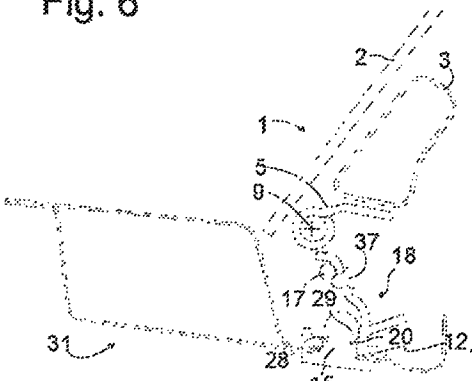
FIG. 6 is the roof frame and luggage compartment flap with hinge in the locked position and the luggage compartment flap open.
Figure 7:
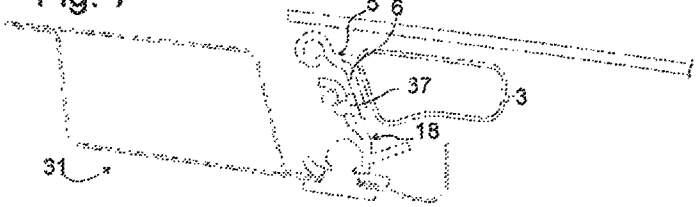
FIG. 7 is the roof frame and luggage compartment flap in the closed position.

FIGS. 5 to 7 use schematic sections to illustrate the assembly of the luggage compartment flap 1 on the roof frame here marked 31. The roof frame 31 includes two metal sheets 32, 33, which are welded together along flanges 34, 35 strung out in the transverse direction of the vehicle, so as to form the hollow profile of the roof frame 31. Formed at the rear of the two flanges 35 are two passages 36, into which a respective post 15 is inserted from below and welded by way of its foot 24 to the lower side of the flange 35.

The base plate 13 of the body-side fitting part 12 lies on the upper side of the flange 34, wherein the post 15 engages into the passage 14 of the base plate 13. Since parts lying outside the section plane are not shown on FIGS. 5 to 7, the only visible parts of the control part 18 are essentially the rear wall 22, the gripping section 23 and a short piece of the cylindrical wall 20 at the end of the slot 21. The post 15 does not engage into the slot 21 yet in this position.

On FIG. 6, the control part 18 is pivoted around the pin 17 into the locked position, in which the cylindrical wall 20 engages into the groove 28 of the post 15. The luggage compartment flap 1 itself is still in the open position, as on FIG. 5.

However, after the body-side fitting part 12 has been locked by the control part 18 engaging into the groove 28 on the roof frame 31, the luggage compartment flap 1 can be downwardly pivoted into the closed position, as shown on FIG. 7. In the closed position, the base plate 6 of the flap-side fitting part 5 abuts firmly against a rubber buffer 37 of the control part 18, and the control part 18 is immovably fixed between the post 15 on the one hand and the base plate 6 on the other. This prevents the hinged lock from detaching with the luggage compartment flap closed 1. In addition, the control part 18 is exposed to an impact each time the luggage compartment flap 1 is closed, which impinges it into the locked position. As a result, the luggage compartment flap 1 cannot cause the lock to inadvertently be released even with repeatedly opening and closing. By contrast, lifting the gripping section 23 makes it possible to smoothly release the lock with the flap open 1 without a tool, and since the flap 1 lies stably on the roof frame 31 even after unlocked, a single user can dismantle the flap 1 without expending any effort, even when only holding it up at its free end.

Figure 8:
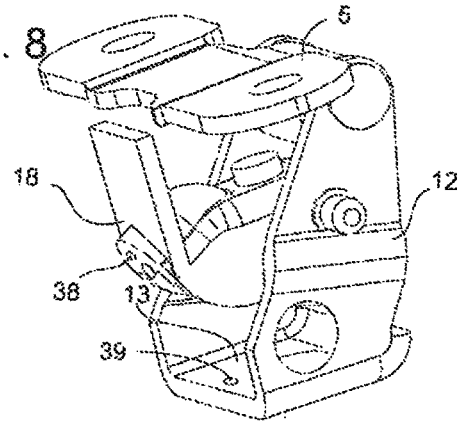
FIG. 8 is the hinge according to another embodiment.
Figure 9:
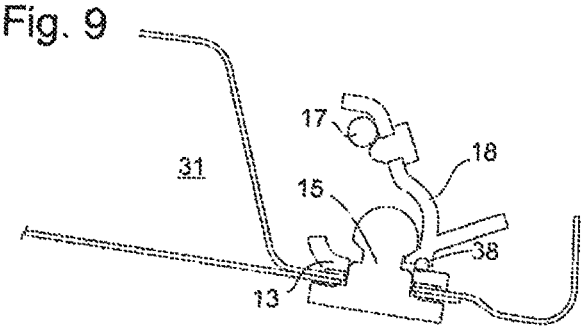
FIG. 9 is a section through the hinge locked to the roof frame according to the embodiment shown in FIG. 8.

FIGS. 8 and 9 show a perspective view or section of a variant of the hinge 4, in which a spring-loaded ball 38 is recessed on the sole of the cylindrical wall 20 between the end of the slot 21 and the rear wall 22. Complementarily thereto, a recess 39 is formed in the base plate 13, into which the ball 38 latches in the locked position. In order to pivot the control part 18 out of the locked position into the released position shown on FIG. 8, the spring resistance holding the ball 38 pressed into the recess 39 must thus be overcome.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A hinge assembly for a vehicle having a flap pivotably attached to a body, the hinge assembly comprising:

a first fitting part having a passage formed therein;

a second fitting part operably coupled to the first fitting part so that it can pivot around a first axis; and a control part coupled to the first fitting part and movable between a locked position to engage between a head of a post and the first fitting part, and a released position to disengage the head of the post.

2. The hinge assembly according to claim 1, wherein the control part comprises a slot for receiving the head so that the control part engages between the head and the first fitting part in the locked position.

3. The hinge assembly according to claim 1, wherein the control part pivotable around a second axis between the locked position and released position.

4. The hinge assembly according to claim 3, wherein the second axis is located between the first axis and the passage.

5. The hinge assembly according to claim 1, wherein first fitting part comprises includes a base plate in which the passage is formed, and straps angled on either side of the base plate for supporting at least one pin.

6. The hinge assembly according to claim 5, wherein the control part further comprises a gripping section protruding out of a gap between the straps in the locked position.

7. The hinge assembly according to claim 1, wherein the second fitting part prevents movement of the control part from the locked position into the released position when the flap is in a closed position.

8. The hinge assembly according to claim 7, further comprising a buffer biased between the second fitting part and the control part when the flap is in the closed position.

9. The hinge assembly according to claim 1, wherein the post has a groove formed around the head to provide a flank for engaging the control part.

10. The hinge assembly according to claim 1 wherein the first fitting part is configured to fold over the post from above the head.

11. A vehicle comprising a flap pivotably attached to a body and the hinge assembly according to claim 1.

12. The vehicle according to claim 10, wherein the head of the post is configured to traverses a passage in a first vehicle part, and a base of the post abuts against a side of the first vehicle part facing away from the hinge.

13. The vehicle according to claim 12, wherein the first vehicle part comprises the body and the second vehicle part comprises the flap.

14. The vehicle according to claim 11, wherein the flap comprises a luggage compartment flap.

* * * * *